US006312183B1

(12) United States Patent
Arnold

(10) Patent No.: US 6,312,183 B1
(45) Date of Patent: Nov. 6, 2001

(54) DEVICE AND METHOD FOR RETAINING AND DISPLAYING A COLLECTION OF FOLDED CARDS

(76) Inventor: L. Taylor Arnold, 5015 Dunwoody Trail, Raleigh, NC (US) 27606-1726

( * ) Notice: Subject to any disclaimer, the term of this patent is extended or adjusted under 35 U.S.C. 154(b) by 0 days.

(21) Appl. No.: 09/655,746

(22) Filed: Sep. 6, 2000

(51) Int. Cl.[7] ..... B42F 13/00

(52) U.S. Cl. ..... 402/79; 40/124.01; 211/45; 281/29; 281/48; 402/80 R; D19/26

(58) Field of Search ..... 402/79, 80 R, 402/80 P; 281/48, 21.1, 28, 29, 32, 37, 42, 38; 40/124, 657, 658; D19/26, 27, 32; 211/45; D11/117, 118; 24/67.12, 67.3, 67.11

(56) References Cited

U.S. PATENT DOCUMENTS

| | | | | |
|---|---|---|---|---|
| 460,090 | * | 9/1891 | Fitzpatrick et al. | 281/48 |
| 1,430,335 | * | 9/1922 | Stengel | 281/29 |
| 1,619,434 | * | 3/1927 | Reese | 40/124 |
| 1,966,570 | * | 7/1934 | Weatherford | 40/124 |
| 2,336,214 | * | 12/1943 | Bartels | 281/29 |
| 2,474,447 | * | 6/1949 | Wheelock | 281/29 |
| 3,170,260 | * | 2/1965 | Parker | 40/124 |
| 3,789,526 | | 2/1974 | Folson . | |
| 4,749,090 | * | 6/1988 | Darmanin | 40/124 |
| 4,852,280 | * | 8/1989 | Beattie | 40/124 |
| 5,265,914 | * | 11/1993 | Russell | 281/42 |
| 5,480,036 | * | 1/1996 | Opar | 40/124 |
| 5,573,276 | * | 11/1996 | Nomura et al. | 281/48 |
| 5,713,684 | | 2/1998 | Turecamo . | |
| 5,772,349 | | 6/1998 | Tubergen | 402/79 |
| 6,108,952 | * | 8/2000 | Whittlef | 40/124 |

* cited by examiner

*Primary Examiner*—Willmon Fridie, Jr.
*Assistant Examiner*—Monica Carter
(74) *Attorney, Agent, or Firm*—LaMorte & Associates

(57) ABSTRACT

An assembly for retaining and displaying a plurality of greeting cards in a space efficient manner is claimed. The assembly includes an album structure that has a front cover and a back cover. Both the front cover and the back cover have interior surfaces that face each other when said album structure is closed. A plurality of elastic cord segments are arranged in parallel lines across the interior surface of at least one of the covers. A plurality of elastic cords can also be present on separate sheets that are bound within the album structure. Greeting cards can be placed around each of the segments of elastic cords. The elastic cords retain the greeting cards in an overlapping pattern in the same plane as the surface that supports the segments of elastic cords. Each segment of elastic cord can engage at least one greeting card. As such, multiple greeting cards can be retained and displayed on each surface that supports the elastic cords.

13 Claims, 4 Drawing Sheets

DEVICE AND METHOD FOR RETAINING AND DISPLAYING A COLLECTION OF FOLDED CARDS

BACKGROUND OF THE INVENTION

1. Field of the Invention

In general, the present invention relates to structures that are designed to retain and display folded cards, such as greeting cards, Christmas cards and the like. More particularly, the present invention relates to card retaining devices that are constructed as a folder, portfolio, album or like binding.

2. Description of the Prior Art

The sending of folded greeting cards has become a tradition for many social and religious events, such as Christmas, Mother's day, birthdays and the like. When people receive greeting cards, they often like to display the greeting cards for a short period surrounding the event that generated the sending of the cards. However, many folded greeting cards tend to be large and bulky. As such, it is difficult to display a large number of folded greeting cards in a confined space.

Recognizing the need to minimize the space required to display a large collection of greeting cards, many prior art card holders have been developed. Many of these prior art card holding devices hold a plurality of greeting cards around a central hub, wherein the greeting cards radially extend from the central hub. Such prior art greeting card holders are exemplified by U.S. Pat. No. 3,789,526 to Lavinson, entitled Card Holder; U.S. Pat. No. 3,524,274 to Glassburn, entitled Card Holding And Displaying Device; and U.S. Pat. No. 4,852,280 to Beattie, entitled Greeting Card Holding And Displaying Apparatus.

The fact that folded greeting cards are difficult to display in a confined space also makes it hard for a retailer or a printer to conveniently display greeting cards that are for sale. The display of greeting cards consumes so much space, that department stores often dedicate whole aisles for the display of folded greeting cards. The use of large areas of floor space is an option for retailers with big stores. However, small printing shops and individual salesmen do not have this option. Rather, many smaller printing shops and card salesmen carry bound portfolios that contain samples of the greeting cards that are available for sale. Oftentimes, in order to minimize space, only pictures of the cards are available for viewing in the portfolio. In those cases, a few samples of real greeting cards are provided to help illustrate paper types and printing quality.

Although pictures of greeting cards may be sufficient, many customers prefer to see a real sample of the actual card they are buying or are having printed. It is for this reason that many printing shops and salesmen carry portfolios of actual sample cards. Most portfolios that are designed to hold greeting cards are capable of holding only one or two card samples per page. Examples of such card display portfolios are shown in U.S. Pat. No. 5,772,349 to Tubergen, entitled Greeting Card Album; U.S. Pat. No. 5,713,684 to Turecamo, entitled Greeting Card Album; and U.S. Pat. No. Des 311,208 to Folson, entitled Greeting Card Album. Since only a few greeting cards can be displayed on each page, the sample portfolio is either very large and heavy or the number of sample cards to choose from is limited.

A need therefore exists for a greeting card portfolio system that is capable of display a large number of actual card samples on each page so that a large selection of greeting cards can be displayed in a relatively thin binding. This need is met by the present invention as it is described and claimed below.

SUMMARY OF THE INVENTION

The present invention is an assembly for retaining and displaying a plurality of greeting cards in a space efficient manner. The assembly includes an album structure that has a front cover and a back cover. Both the front cover and the back cover have interior surfaces that face each other when said album structure is closed. A plurality of elastic cord segments are arranged in parallel lines across the interior surface of at least one of the covers. Plurality of elastic cords can also be present on separate sheets that are bound within the album structure.

Greeting cards can be placed around each of the segments of elastic cords. The elastic cords retain the greeting cards in an overlapping pattern in the same plane as the surface that supports the segments of elastic cords. Each segment of elastic cord can engage at least one greeting card. As such, multiple greeting cards can be retained and displayed on each surface that supports the elastic cords.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention assembly can be used to retain and display any type of folded paper product, such as invitations, wedding announcements and the like, it is especially well suited for retaining and displaying folded greeting cards. As such, by way of example, the present invention assembly will be described in an application where it is used to retain and display greeting cards. Such an application is merely exemplary and is presented as the most likely use of the invention.

Figure 1:
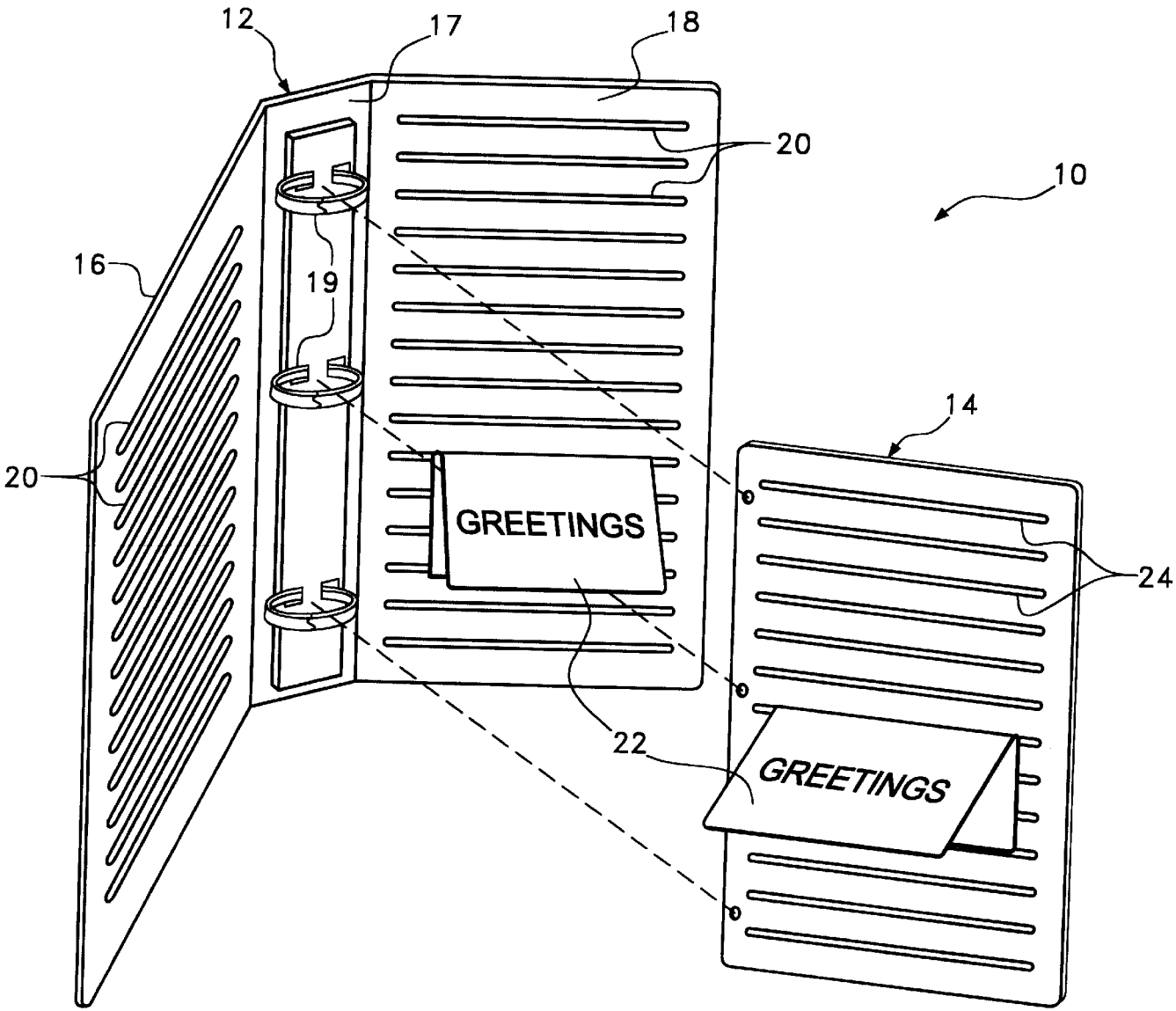
FIG. 1 is an exploded perspective view of an exemplary embodiment of a display album assembly in accordance with the present invention.

Referring to FIG. 1, an exemplary embodiment of a display album assembly 10 is shown. The display album assembly 10 is comprised of the main album binder 12 and album sheets 14 that can be selectively added to, or removed from, the main album binder 12.

The main album binder 12 has the general shape of a commercial three ring binder, in that the main album binder 12 has a front cover 16, a back cover 18 and a center spine 17 that joins the front cover 16 to the back cover 18. The center spine 17 contains three conventional ring clips 19 that are common to three ring binders.

The unique aspects of the main album binder 12 include the structure of the interior surface of its front cover 16 and back cover 18. On the interior surface of both the front cover 16 and the back cover 18 are segments of elastic cord 20.

The different segments of elastic cord 20 are arranged in parallel lines, wherein each of the segments of elastic cord 20 extends across at least eighty percent (80%) of the width of the front cover 16 or back cover 18. Depending upon the size of the main album binding 12, both the front cover 16 and the back cover 18 can support between four and twenty parallel segments of elastic cord 20.

To retain and display a greeting card 22 on the interior of either the front cover 16 or the back cover 18, one of the segments of elastic cord 20 is stretched away from the cover and a greeting card 22 is placed between the segment of elastic cord 20 and the cover. The segment of elastic cord 20 is oriented across the fold line in the center of the greeting card 22. In this manner, one side of the greeting card 22 extends upwardly from the segment of elastic cord 20 and the opposite side of the card 22 extends downwardly from that same segment of elastic cord 20. The displayed greeting card 22 is capable of closing around the segment of elastic cord 20. As a result, the greeting card 22 lay flat in the primary plane of the album assembly's covers 16, 18, when the main album binder 12 is closed.

Due to the density of the parallel segments of elastic cord 20 on both the front cover 16 and the back cover 18, greeting cards 22 will overlap as they are placed around each of the segments of elastic cord 20. As a result, both the front cover 16 and the back cover 18 of the main album binder 12 can retain and display between four and twenty full sized greeting cards 22.

The main album binder 12 is adapted to receive any number of album sheets 14. The number of album sheets 14 that can be placed in the main album binder 12 is dependent upon the size and capacity of the ring clamps 19 present within the main album binder 12. The album sheets 14 have a construction very similar to that of the front cover 16 and back cover 18 of the main album binder 12. Each album sheet 14 has two face surfaces. (Only one shown in FIG. 1.) On each of the face surfaces are a plurality of parallel segments of elastic cord 24. The segments of elastic cord 24 extend across at least eighty percent (80%) of the width of the album sheet 14. Depending upon the size of the album sheet 14, both sides of the album sheet 14 can support between four and twenty parallel segments of elastic cord 24.

To retain and display a greeting card 22 on either side of the album sheet 14, one of the segments of elastic cord 24 is stretched away from the album sheet 14 and a greeting card 22 is placed between the segment of elastic cord 24 and the face surface of the album sheet 14. The segment of elastic cord 24 is oriented across the fold line in the center of the greeting card 22. The displayed greeting card 22 is capable of closing around the segment of elastic cord 24. As a result, the greeting card 24 lay flat in the primary plane of the album sheet 14 when the album sheet 14 is closed within the main album binder 12.

Figure 2:
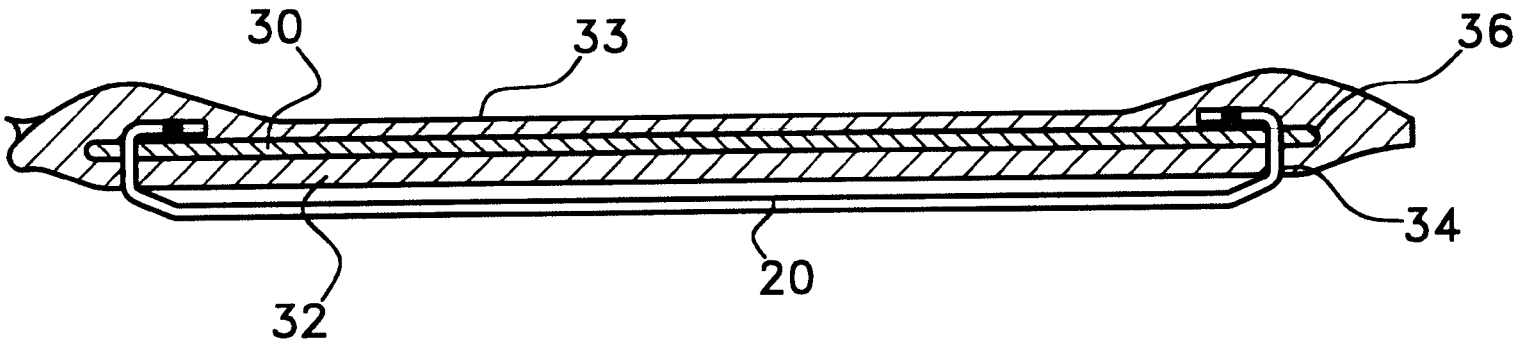
FIG. 2 is cross-sectional view of the back cover of the display album shown in FIG. 1.

Since segments of elastic cord 20, 24 are used on both the main album binder 12 and the album sheets 14, the main album binder 12 and the album sheets 14 must have enough rigidity to resist bending under the bias of the elastic cords. Referring now to FIG. 2, it can be seen that contained within each cover of the main album binder 12 is a reinforcement panel 30. The reinforcement panel 30 is made of cardboard or another inexpensive rigid material. The reinforcement panel 30 is covered with a decorative inner lining 32 and outer lining 33. The material of the inner lining 32 and outer lining 33 can be vinyl, leather, cloth or any other material traditionally used on binder covers. Pairs of holes 34 are present through the inner lining 32. The pairs of holes 34 in the inner lining 32 align with pairs of holes 36 on the reinforcement panel 30. The segments of elastic cord 20 are stretched between the holes 34 in the inner lining 32. The ends of each segment of elastic cord 20 are passed through the holes 36 in the reinforcement panel 30, wherein the ends of the segments of elastic cord 20 are stapled, glued, knotted or otherwise prevented from withdrawing from the holes. Since the segments of elastic cord 20 pass through the reinforcement panel 30, the reinforcement panel 30 resists the compression forces of the elastic cords 20 and prevents the binder cover from bending.

Figure 3:
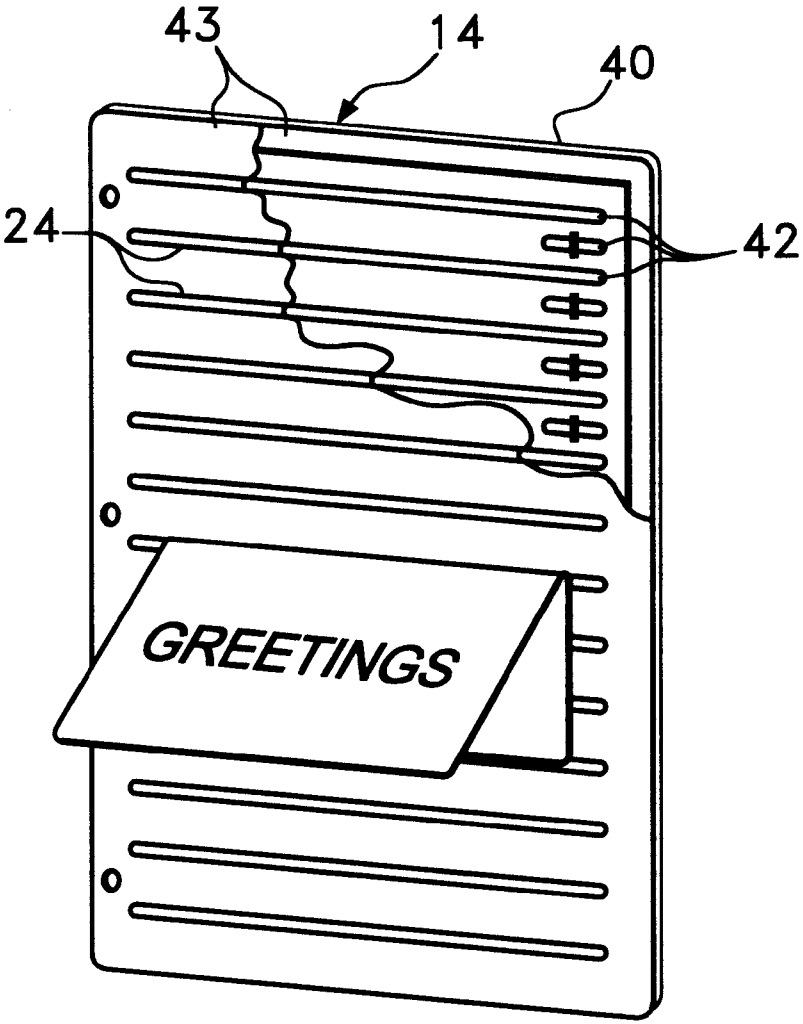
FIG. 3 is a fragmented view of the album sheet shown in FIG. 1.

Referring to FIG. 3, it can be seen that the album sheets 14 are constructed in a similar manner. Each album sheet 14 contains a reinforcement panel 40 that is lined on both sides. Pairs of holes 42 are formed through the reinforcement panel 40 and the linings 43. The holes in either lining 43 align with alternating rows of holes 42 in the reinforcement panel 40. The ends of each segment of elastic cord 24 are passed through the holes in the reinforcement panel 40, from both sides of the album sheet 14. The ends of the segments of elastic cord 24 are then either stapled, glued, knotted or otherwise prevented from withdrawing from the holes 42.

In the embodiment of FIG. 1, the main album binder 12 is configured as a three ring binder and the album sheets 14 are configured to engage a three ring binder. Such a configuration is merely exemplary. In the prior art, there exist many different ways to selectively bind a sheet to an album other than with a three ring binder configuration. Any such prior art binding system can be adapted for use with the present invention.

Figure 4:
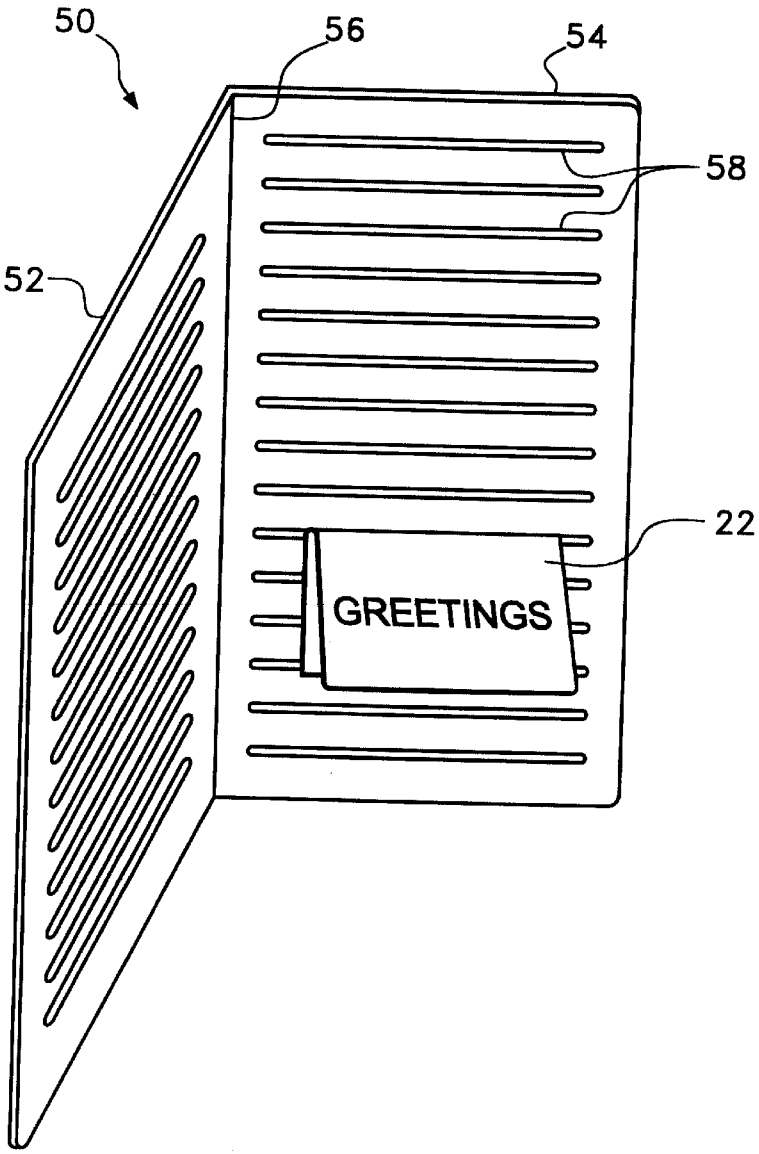
FIG. 4 is a perspective view of a display portfolio in accordance with the present invention.

Furthermore, the present invention assembly need not have an album binder and album sheets that can be attached to the album binder. Rather the present invention assembly can be configured as a set portfolio. Referring to FIG. 4, a portfolio 50 is shown in accordance with the present invention. The portfolio 50 contains a front cover 52 and a back cover 54 joined together along a common hinged seam 56. The interior surface of the front cover 52 and the interior surface of the back cover 54 are constructed to receive and retain greeting cards 22. Both the front cover 52 and the back cover 54 contain parallel rows of elastic cord segments 58 that are used to retain greeting cards 22 in the same manner as previously described in the original embodiment of FIG. 1.

It will be understood that the embodiments of the present invention described and illustrated herein are merely exemplary and a person skilled in the art can make many variations to the embodiments shown without departing from the scope of the present invention. All such variations, modifications and alternate embodiments are intended to be included within the scope of the present invention as defined by the appended claims.

What is claimed is:

1. An assembly for retaining and displaying a plurality of greeting cards, said assembly comprising:

an album structure having a front cover and a back cover, wherein both said front cover and said back cover have interior surfaces that face each other when said album structure is closed;

a first plurality of elastic cord segments arranged in parallel lines on at least one of said interior surfaces, a plurality of sheet elements coupled to said album structure between said front cover and said back cover, wherein each of said sheet elements contains two face surfaces and at least one of said face surfaces contains a second plurality of elastic cord segments arranged in parallel thereon.

2. The assembly according to claim 1, wherein a first plurality of elastic cord segments are arranged in parallel lines on both of said interior surfaces.

3. The assembly according to claim 1, wherein said album structure has a parallel top edge and bottom edge, and wherein said first plurality of elastic cord segments are parallel to both said top edge and said bottom edge.

4. The assembly according to claim 1, wherein said front cover has a predetermined width and each of said first plurality of elastic cord segments extend across at least eighty percent of said predetermined width.

5. The assembly according to claim 1, wherein said back cover has a predetermined width and each of said first plurality of elastic cord segments extend across at least eighty percent of said predetermined width.

6. The assembly according to claim 1, wherein each of said face surfaces contains a plurality of elastic cord segments arranged in parallel thereon.

7. The assembly according to claim 1, further including a three ring binding clamp disposed between said front cover and said back cover.

8. The assembly according to claim 1, wherein each said front cover and said back cover are directly connected to one another along a hinged seam.

9. The assembly according to claim 8, wherein said front cover has a top edge, a bottom edge and two side edges, and said first plurality of elastic bands lay parallel to said top edge and said bottom edge.

10. An assembly for displaying folded paper cards, comprising:

a book structure having a front cover and a back cover, wherein both said front cover and said back cover have an interior surface;

a first plurality of elastic bands extending in parallel rows across said interior surface of said front cover;

a second plurality of elastic bands extending in parallel rows across said interior surface of said back cover;

a plurality of sheet elements coupled to said book structure between said front cover and said back cover, wherein each of said sheet elements contains two face surfaces and at least one of said face surfaces contains a third plurality of elastic cord segments arranged in parallel thereon.

11. The assembly according to claim 10, wherein said side edges are a predetermined distance apart and each of said first plurality of elastic bands extends a length across said front cover that is at least eighty percent of said predetermined distance.

12. An insert for a three-ring binder that is used to display greeting cards, comprising:

a planar structure having a front planar surface, a back planar surface, defined by a top edge, a bottom edge, a first side edge and a second side edge, wherein said planar structure defines apertures for use in attachment to a three-ring binder;

a plurality of elastic cords extending across said front planar surface and said back planar surface from points proximate said first side edge to points proximate said second side edge, wherein each of said plurality of elastic cords lay in parallel to both said top edge and said bottom edge.

13. The display according to claim 12, wherein said first side edge and said second side edge are a predetermined distance apart and each of said plurality of elastic cords extend a length that is at least eighty percent of said predetermined distance.

* * * * *